United States Patent [19]

Yoshida

[11] Patent Number: 4,480,432

[45] Date of Patent: Nov. 6, 1984

[54] INCLINED VERTICAL TYPE STRANDING MACHINE

[75] Inventor: Tokuji Yoshida, Tokyo, Japan

[73] Assignee: Yoshida Kogyo Kabushiki Kaisha, Tokyo, Japan

[21] Appl. No.: 444,926

[22] Filed: Nov. 26, 1982

[51] Int. Cl.[3] ..... D07B 3/10

[52] U.S. Cl. ..... 57/58.65; 57/58.52; 57/58.81; 57/58.72

[58] Field of Search ..... 57/58.65–58.68, 57/58.72–58.81, 58.52

[56] References Cited

U.S. PATENT DOCUMENTS

| | | | |
|---|---|---|---|
| 3,147,580 | 9/1964 | Blaisdell et al. | 57/58.65 X |
| 3,147,581 | 9/1964 | Godderidge | 57/58.65 X |
| 3,793,819 | 2/1974 | Madalozzo et al. | 57/58.67 X |
| 4,339,909 | 7/1982 | Godderidge | 57/58.67 X |

*Primary Examiner*—John Petrakes
*Attorney, Agent, or Firm*—Jordan and Hamburg

[57] ABSTRACT

A stranding machine wherein element wires are twisted twice for every turn of the flyer and thus obtained stranded wires are wound on a bobbin positioned inside the flyer in such a manner as to be rotatable thereto. This is an inclined vertical type stranding machine wherein the revolution axis of the flyer is inclined to the vertical line so that the direction of gravity force exerted on the floating frame supporting the bobbin is inclined to the revolution axis of the flyer, which makes it easy to keep the floating frame stationary. This is also a constant Pitch stranding machine provided with a device which control the running speed of stranded wires to keep the ratio of the running speed of stranded wires and twice the revolution rate of the flyer, that is, the pitch of the stranded wires.

4 Claims, 3 Drawing Figures

INCLINED VERTICAL TYPE STRANDING MACHINE

BACKGROUND OF THE INVENTION

This invention relates to a stranding machine, more particularly to a vertical twin-type, uniform pitch stranding machine.

There has been provided a vertical type double-twist stranding machine which is space-saving compared with horizontal type double-twist machines. This conventional vertical double-twist stranding machine shown in FIG. 3 has a floating frame 103 mounted on a flyer 102 having a vertical flyer shaft 102A rotatably supported on a stand 101, said floating frame 103 having a take-up bobbin 109. Usually, in this type of machine is employed a planet gear system, in order to keep the floating frame stationary while the flyer is rotating. This gear system consists of a sum gear 104 fixed to the stand 101 coaxially with the flyer shaft 102A, another sun gear 107 which has the same number of teeth with the gear 104 and is attached to the floating frame 103 also coaxially with the flyer shaft 102A, and a pair of planet gears 105, 106, which, having the same number of teeth each other, are connected together by means of a planet gear shaft 108 penetrating a portion of the flyer 102, and engage with said sun gears 104 and 107 respectively. This planet gear system certainly make it possible to positively keep the floating frame and hence the take-up bobbin 109 stationary regardless of revolution of the flyer. The very fact, however, that such a complex device as a planet gear system must be employed solely for the purpose of keeping the floating frame stationary forms a drawback.

SUMMARY OF THE INVENTION

The fundamental object of the present invention is to provide a novel, inclined vertical type stranding machine which dispenses with the planet gear system and yet can keep the floating frame stationary, thereby eliminating the drawback of the conventional vertical type stranding machines.

Another object of the invention is to provide a stranding machine equipped with a novel control system which keep the pitch of stranded wires constant.

A further object of the invention is to provide novel twin-type stranding machine which is more space-saving for installation and time-saving in replacement of take-up bobbins than single unit type stranding machines.

DETAILED DESCRIPTION OF THE PREFERRED EMBODIMENTS

Figure 1:
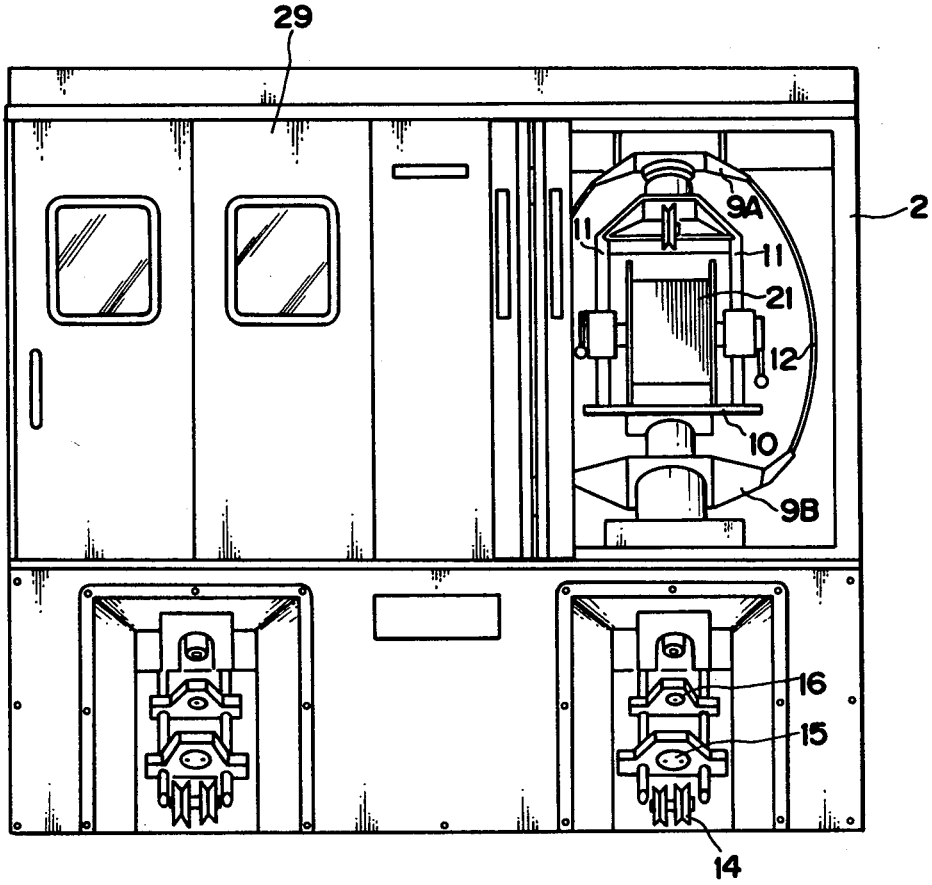
FIG. 1 is a front view of an embodiment of the invention.
Figure 2:
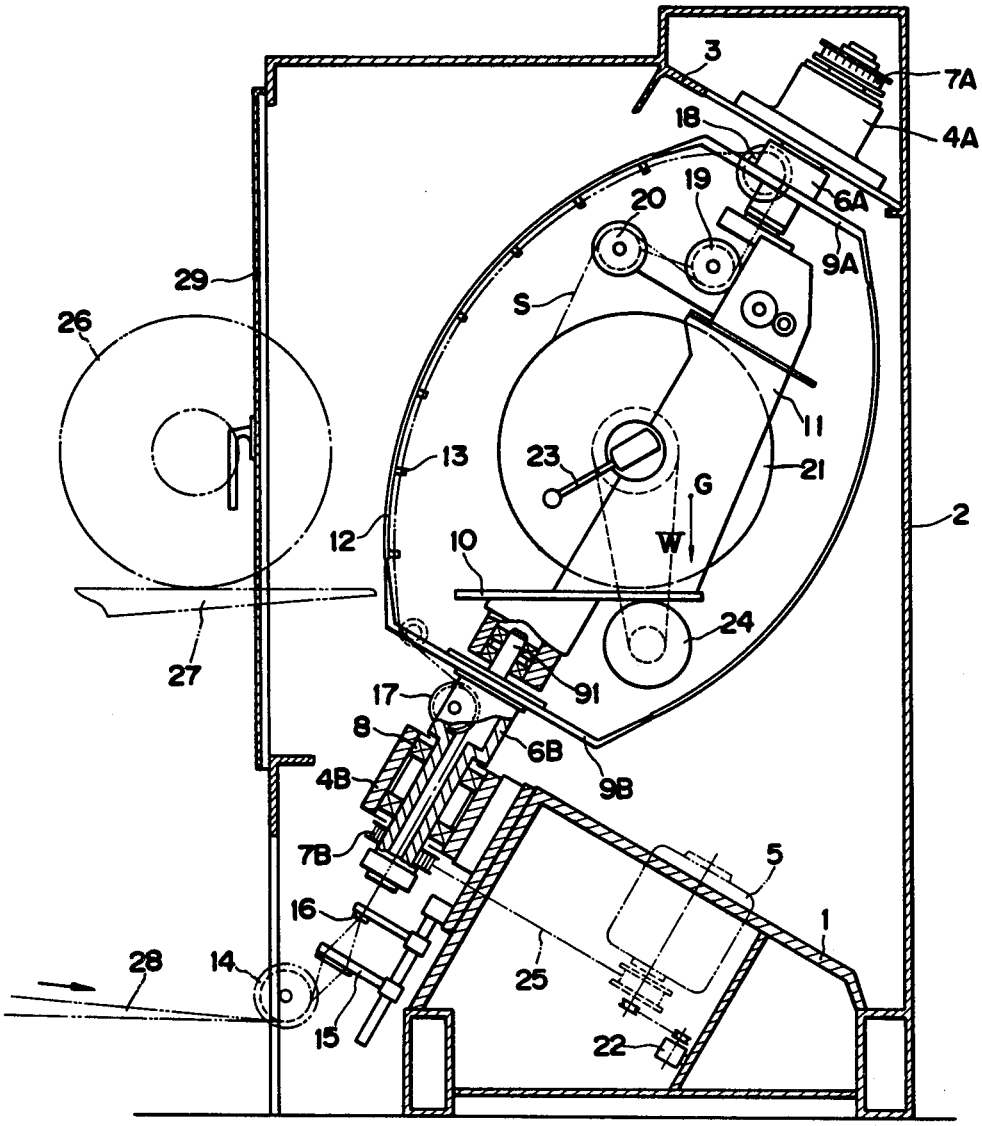
FIG. 2 is a somewhat enlarged sectional side view of the same embodiment.
Figure 3:
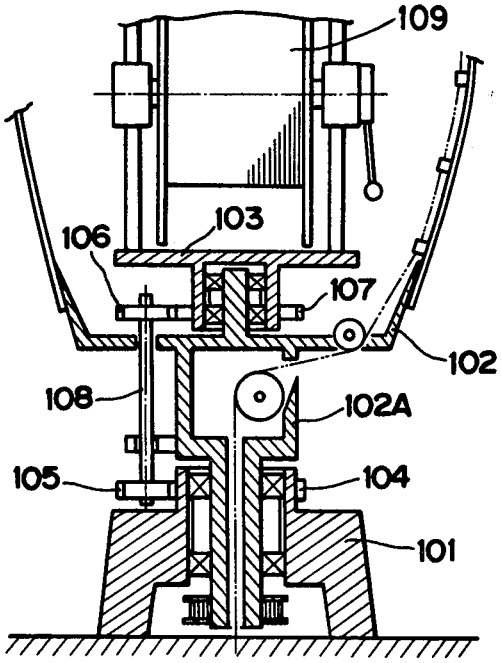
FIG. 3 Prior Art
FIG. 3 is a sectional side view of a part of a conventional vertical type stranding machine illustrating a planet gear system for keeping the floating frame stationary.

The stranding machine according to the invention is of twin-type as shown in FIG. 1, where one of doors 29 of a casing 2 is shown open and the stranding unit on the right is seen from outside. One of the stranding units in FIG. 1 will be described with reference to FIG. 2 which is a somewhat enlarged sectional side view thereof.

On the stand 1 is mounted a hollow cylindrical lower bearing case 4B which supports rotatably a generally hollow cylindrical lower flyer shaft 6B through a ball or roller bearing 8. The lower flyer shaft 6B is provided in such a manner that the axis thereof is inclined with respect to the vertical line at an angle of 10°~60°, preferably at about 30°. A frame 3 is provided to be fixed with respect to the stand through the casing 2, and on the frame 3 is mounted a hollow cylindrical upper bearing case 4A coaxially with the lower bearing 4B.

A lower flyer plate 9B is attached to the lower flyer shaft 6B, and an upper flyer plate 9A is fixed to an upper flyer shaft 6A which is mounted on the upper bearing case 4A rotatably through a ball or roller bearing.

The upper flyer plate 9A and the lower flyer plate 9B are connected together at the ends thereof by means of a pair of flyer arms 12, 12 and thereby form a flyer having a hollow portion at the center thereof.

To the lower flyer shaft 6B is attached a lower pulley 7B which is rotated through a driving belt 25 by a flyer driving motor 5 mounted on the stand 1.

To the upper flyer shaft 6A is attached an upper pulley 7A which is rotated at the same speed with the lower flyer shaft 6B by the flyer driving motor 5 through a transmission shaft (not shown).

On the lower flyer plate 9B is provided a shaft 91 for supporting a floating frame coaxially with the lower flyer shaft 6B, and on said shaft 91 is supported rotatably a floating platform 10 of the floating frame described hereinafter through an appropriate rolling contact bearing so as to be in horizontal position. On the floating platform 10 are mounted, as clearly seen in FIG. 1, a pair of floating frame side plates 11, 11 to extend vertically and thereby form generally the floating frame. The upper end of the floating frame is supported by the upper flayer plate 9A. Hence the floating frame is positioned in said central hollow portion of the flyer. A take-up bobbin 21 is supported rotatably by the floating frame side plates 11 and positioned within the floating frame. A direct-current motor 24 for driving the take-up bobbin 21 is provided under the floating platform 10 in a position biased from the axis line of the lower flyer shaft 6B. A clamp handle 23 is provided for fixing the takeup bobbin 21 in the desired position.

Next, several of the component members of the unit shall be described along the running course of element wires 28 or stranded wires S. In the lower position of the casing 2 where element wires 28 are introduced, is provided an entrance roller 14, and from the roller 14 to the lower flyer shaft 6B are provided a wire-separating plate 15 and a stranding die 16 in that order. In the hollow position of the lower flyer shaft 6B is mounted a lower guide roller 17 in such a manner that the groove periphery thereof is in contact with the center line of the shaft 6B, and in the hollow position of the upper flyer shaft 6A is provided an upper guide roller 18 in a similar manner. Between the lower guide roller 17 and the upper guide roller 18 are provided along the flyer arm 12 a number of guide rings 13 for forcing forward and guiding the stranded pair of wires S.

A measure roller 19 is provided on the floating frame in the position corresponding to that of the upper guide roller 18; the number of revolution thereof is to be counted and used as input to the control device described hereinafter. Behind the measure roller 19 is provided on the floating frame side plate 11 a traverse roller 20 which reciprocates along the axis of the take-up bobbin 21. Said traverse roller 20, while supporting the stranded pair S, traverses in the full breadth of the drum of the take-up bobbin 21, and thereby regulates the winding of the stranded pair on the bobbin 21.

Next, the stranding operation and control of the pitch of the stranded pair S shall be described. If the flyer turns, say, n times, the element wires 28 will undergo twists n times between the stranding die 16 and the lower guide roller 17, and further n times between the upper guide roller 18 and the measure roller 19 on the floating frame, hence twists of 2n times into the stranded pair S and wound on the take-up bobbin 21. Appended to the motor 5 for driving the flyer is a tachogenerator 22 which detects number of revolutions n of said motor 5 from which number of twists 2n is at once known. On the other hand, the running speed V of the stranded pair S can be determined from the number of revolution of the measure roller 19. From the above two values, the pitch value, $P=V/2n$ is determined by means of a simple calculating circuit. Hence it is possible to keep the pitch value P to the desired input value Po by comparing the two values and controlling the revolution rate of the DC motor 24 which determines the winding speed of the take-up bobbin 21: when $P>Po$, the revolution rate of the motor 24 is decreased to reduce the running speed V of the stranded pair S while, for $P<Po$, the revolution rate of the motor 24 is increased.

Since the DC motor 24 mounted on the floating platform 10 is biased from the position of the revolution axis of the flyer, even when the take-up bobbin 21 becomes full, the center of gravity G of the whole floating frame is biased from and positioned below the revolution axis of the flyer. Moreover, since the revolution axis is inclined to the vertical line, the moment of gravitational force acting on the total weight of the floating frame including the take-up bobbin 21 is far greater than the torque given to the floating frame by a small friction force produced at the periphery of the shaft 91 of the lower flyer plate 9B and at the floating frame supporting portion of the upper flyer plate 9A due to revolution of the flyer, hence the floating frame can be almost perfectly kept stationary regardless of revolution of the flyer.

In the stranding machine according to the present invention, replacement of the take-up bobbins is an easy job: the door 29 of the casing 2 opened, and the fork 27 of the fork-lift moved toward the floating frame platform 10 so as to be flush therewith, then one can readily replace the full bobbin 21 with a new empty one. The fact that the floating frame platform 10 is horizontal, and that the pair of the floating frame side plates 11 and the floating frame platform 10 form a closure for the take-up bobbin 21 make replacement of the bobbins still easier.

Further, since the stranding machine according to the present invention is of twin-type, replacement of the bobbins in one of the units can be carried out while the other unit is in operating condition.

In the stranding machine according to the invention, it is also possible to provide a take-up capstan employing a gear drive mechanism at the position of the measure roller 19.

What is claimed:

1. A stranding machine for twisting wire elements and winding the twisted wire elements onto a bobbin, comprising a frame, upper and lower bearings connected to the frame, said upper and lower bearings being arranged coaxially in an imaginary line inclined at an angle from 10 to 60 degrees relative to the vertical line of the frame, a flyer having upper and lower hollow flyer shafts rotationally situated in the upper and lower bearings, and at least one flyer arm in the form of a bow for connecting the upper and lower flyer shafts, a floating mechanism having a floating frame freely rotationally supported by the upper and lower flyer shafts to be located substantially along the inclined imaginary line, means for rotationally supporting the bobbin situated on the floating frame, and first driving means for rotating the bobbin held by the bobbin supporting means, the wire elements to be twisted being conducted from outside through one of the upper and lower hollow flyer shafts and then extending to the other of the upper and lower hollow flyer shafts along the flyer arm and finally being connected to the bobbin on the floating mechanism by passing through the other of the upper and lower hollow flyer shafts, a second driving means situated on the frame for rotating the flyer relative to the frame and the floating mechanism, and a constant pitch control device including first measuring means for measuring the speed of the wire elements wound onto the bobbin, and second measuring means for counting the rate of revolution of the second driving means so that the twisting rate relative to a length of the wire elements is determined by controlling the rotational speed of the first and second driving means based on the values obtained by the first and second measuring means.

2. A stranding machine according to claim 1, in which said first measuring means is a measuring roller attached to the floating frame adjacent to the bobbin so that when the wire elements are wound onto the bobbin, the measuring roller is rotated by the wire elements, and the second measuring means is a tachogenerator connected to the second driving means.

3. A stranding machine according to claim 2, in which said floating mechanism further comprises a traverse roller attached to the floating frame so that the traverse roller can be moved in the longitudinal direction of the bobbin to provide equal winding of the wire elements onto the bobbin.

4. A stranding machine according to claim 3, in which said floating frame includes a pair of side plates parallel to the inclined imaginary line, and a platform connected to the side plates, said platform being inclined relative to the side plates so that the platform is always located horizontally inside the frame due to the influence of gravity on the floating frame.

* * * * *